US008336143B2

(12) United States Patent
Lemmer

(10) Patent No.: US 8,336,143 B2
(45) Date of Patent: Dec. 25, 2012

(54) AIR MATTRESS

(76) Inventor: Clayton Lemmer, Grand Island, NE (US)

( * ) Notice: Subject to any disclaimer, the term of this patent is extended or adjusted under 35 U.S.C. 154(b) by 0 days.

(21) Appl. No.: 13/363,610

(22) Filed: Feb. 1, 2012

(65) Prior Publication Data

US 2012/0272456 A1 Nov. 1, 2012

Related U.S. Application Data

(60) Provisional application No. 61/480,436, filed on Apr. 29, 2011.

(51) Int. Cl.
*A47C 27/08* (2006.01)

(52) U.S. Cl. ..... 5/710; 5/706; 5/655.3

(58) Field of Classification Search ..... 5/710–713, 5/706, 655.3, 722, 657, 654
See application file for complete search history.

(56) References Cited

U.S. PATENT DOCUMENTS

| | | | | |
|---|---|---|---|---|
| 4,594,743 | A | 6/1986 | Owen et al. | |
| 4,646,373 | A | 3/1987 | Guldager | |
| 4,998,310 | A | 3/1991 | Olson | |
| 5,373,595 | A | 12/1994 | Johnson et al. | |
| 5,421,044 | A * | 6/1995 | Steensen | 5/710 |
| 5,474,361 | A * | 12/1995 | Hwang et al. | 297/380 |
| 5,560,056 | A * | 10/1996 | Tai | 5/120 |
| 6,317,912 | B1 | 11/2001 | Graebe et al. | |
| 6,711,771 | B2 * | 3/2004 | Cook et al. | 5/713 |
| 6,839,929 | B2 * | 1/2005 | Stolpmann | 5/710 |
| 7,328,472 | B2 | 2/2008 | Chaffee | |
| 7,370,379 | B2 * | 5/2008 | Zheng | 5/655.3 |
| 7,455,744 | B2 | 11/2008 | Mileti et al. | |

* cited by examiner

*Primary Examiner* — Fredrick Conley
(74) *Attorney, Agent, or Firm* — Buckingham, Doolittle & Burroughs, LLP

(57) ABSTRACT

An architecture is presented that provides an inflatable device usable as a portable adjustable air mattress. The inflatable device comprises a plurality of inflatable tubes aligned by an outer cover forming a substantially rectangular shaped air mattress that will continue to function and provide support even in the event of an air leak.

4 Claims, 6 Drawing Sheets

AIR MATTRESS

CROSS-REFERENCE

This application claims priority from Provisional Patent Application Ser. No. 61/480,436 filed Apr. 29, 2011.

FIELD OF THE INVENTION

This invention pertains generally to an inflatable device for use as an air mattress, and more particularly to a portable air mattress that is adjustable in size and that will not completely deflate in the event of an air leak.

BACKGROUND

Traditional air mattresses can be very uncomfortable to use. Small air leaks, such as those caused by a puncture from a pin or twig, can easily develop and cause the entire mattress to gradually deflate while in use. This may lead to a lack of body support, which may cause users to experience stiff joints and sore muscles, or worse it may render the mattress completely unusable. Additionally, traditional air mattresses cannot be customized by size. Some mattresses may be too small to accommodate multiple house guests as necessary, while other mattresses may be too large to fit into a smaller space, such as a tent. Therefore, consumers may be required to purchase more than one air mattress for a variety of individual applications, which can be very expensive.

Consequently, an air mattress that is comfortable to use, even in the event of an air leak in one or more chambers, and that is adjustable to a variety of sizes is needed. The proposed invention allows individuals to use an air mattress in a variety of situations without fear that an air leak will lead to an uncomfortable experience. Further, the device easily adjusts in size allowing for use by one or more people as needed or as available space dictates.

SUMMARY

Accordingly, the present invention overcomes the limitations of the prior art by providing a unique and useful inflatable device that permits one or more individuals to sleep or lay on it while not becoming uncomfortable or unusable in the event of an air leak.

The following presents a simplified summary in order to provide a basic understanding of some novel embodiments described herein. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises an inflatable device for use as an air mattress. In one embodiment, the inflatable device comprises a plurality of independent inflatable tubes held in place by an encapsulating outer cover and at least one adjusting element. When the plurality of tubes are inflated, the inflatable device forms a generally rectangular-shaped air mattress suitable for comfortably supporting one or more individuals. To utilize the device, pressurized air is introduced into as many of the independent inflatable tubes as desired based on the number of proposed users of the device and any space limitations associated with the physical setting in which the device will be deployed. The amount of pressurized air introduced into each of the independent inflatable tubes can depend upon user preference, and the at least one adjusting element can be engaged to help support the shape and size of the device once the tubes are installed therein.

In the event of an air leak in any one of the independent inflatable tubes, the leaking tube is simply deflated and-folded in on itself, while the remaining tubes remain firmly inflated. Then the at least one adjusting element is repositioned to remove the unnecessary space created by the deflated tube and to provide further stability for the smaller sized device. Additionally, an initial size of the inflatable device depends on the number of tubes initially inflated. The at least one adjusting element will hold in place any uninflated tubes while still allowing for a fully supported air mattress structure.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION

Figure 1:
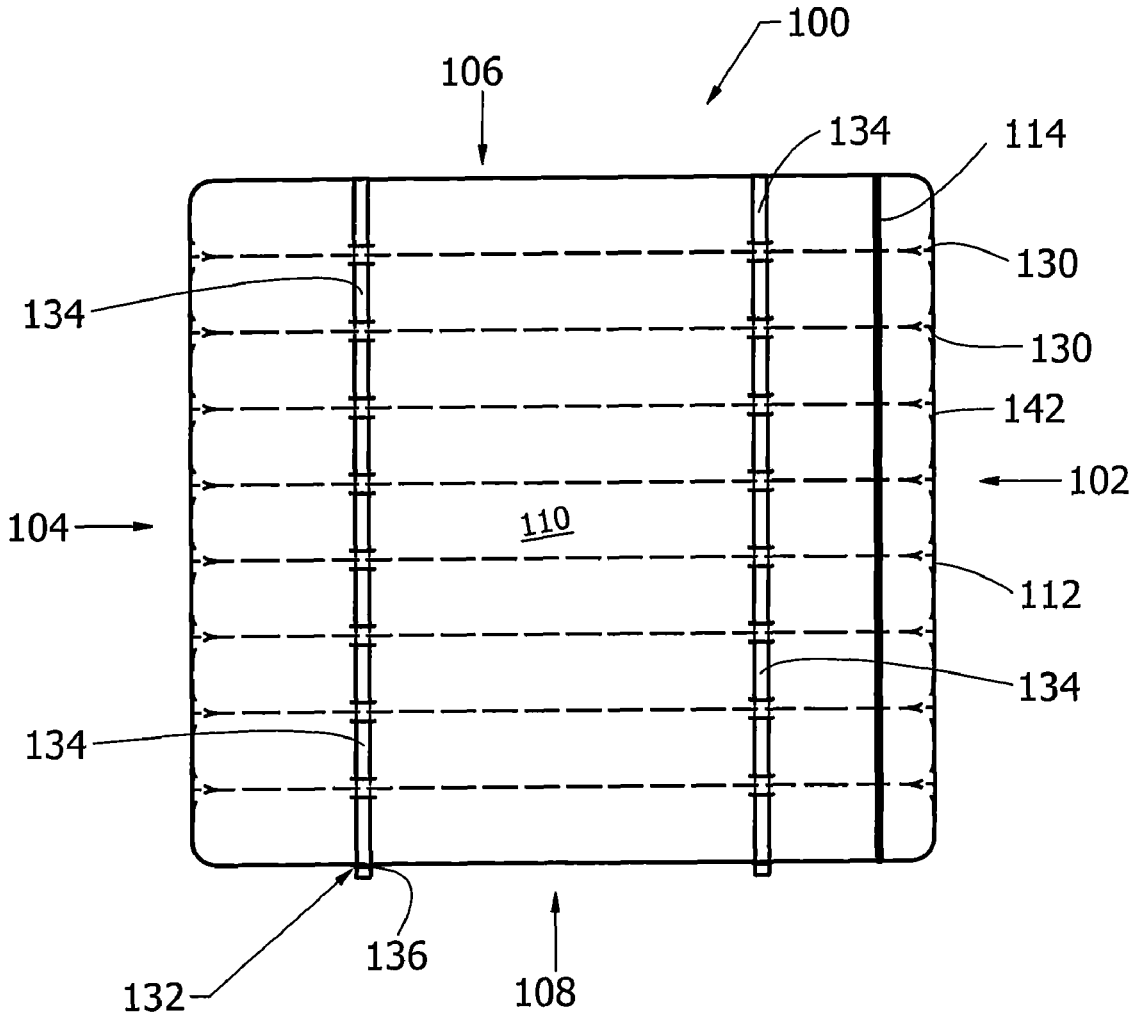
FIG. 1 illustrates a perspective view of a preferred embodiment of an inflatable device in accordance with the disclosed architecture.

Conventional air mattresses typically either completely deflate or otherwise lose enough pressure to become substantially unusable in the event of an air leak. Without a patch kit or a second air mattress, a user is forced to sleep on the ground in an uncomfortable and unsupported position. Accordingly, the disclosed device is designed to remain usable as an air mattress in the event of a leak without the need for an immediate patch or secondary mattress. Additionally, the device is customizable by size to accommodate single or multiple users as desired or to fit an available space such as a small tent as necessary so that a single device may service multiple applications.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter.

Referring initially to the drawings, FIG. 1 illustrates an inflatable device 100 usable as an air mattress. For example, the inflatable device 100 may be used to support at least one person as a spare single or multi-person bed, a camping mattress, or any other application that may benefit from a portable and adjustable support platform such as a water flotation device. The inflatable device 100 comprises an outer cover 112, a plurality of inflatable tubes 120, and at least one adjusting element 132. The outer cover 112 is configured to substantially encapsulate the plurality of inflatable tubes 120 both when inflated and deflated. Therefore, the outer cover 112 typically comprises a resilient material such as polyethylene However, this in not meant as a limitation as the outer cover 112 may be manufactured from a variety of different materials such as, but not limited to, thermoplastics, rubber, plastic, canvas, fabric, nylon, polyester, synthetic polymers, poly vinyl chloride sheeting, and the like. These materials are desirable as they are durable, flexible, and inexpensive to manufacture. Additionally, the outer cover 112 may comprise a plurality of layers of material to increase the puncture resistance of the inflatable device 100. However, in the preferred embodiment the outer cover 112 is generally a single layer of material between 1 and 15 millimeters thick.

Figure 6:
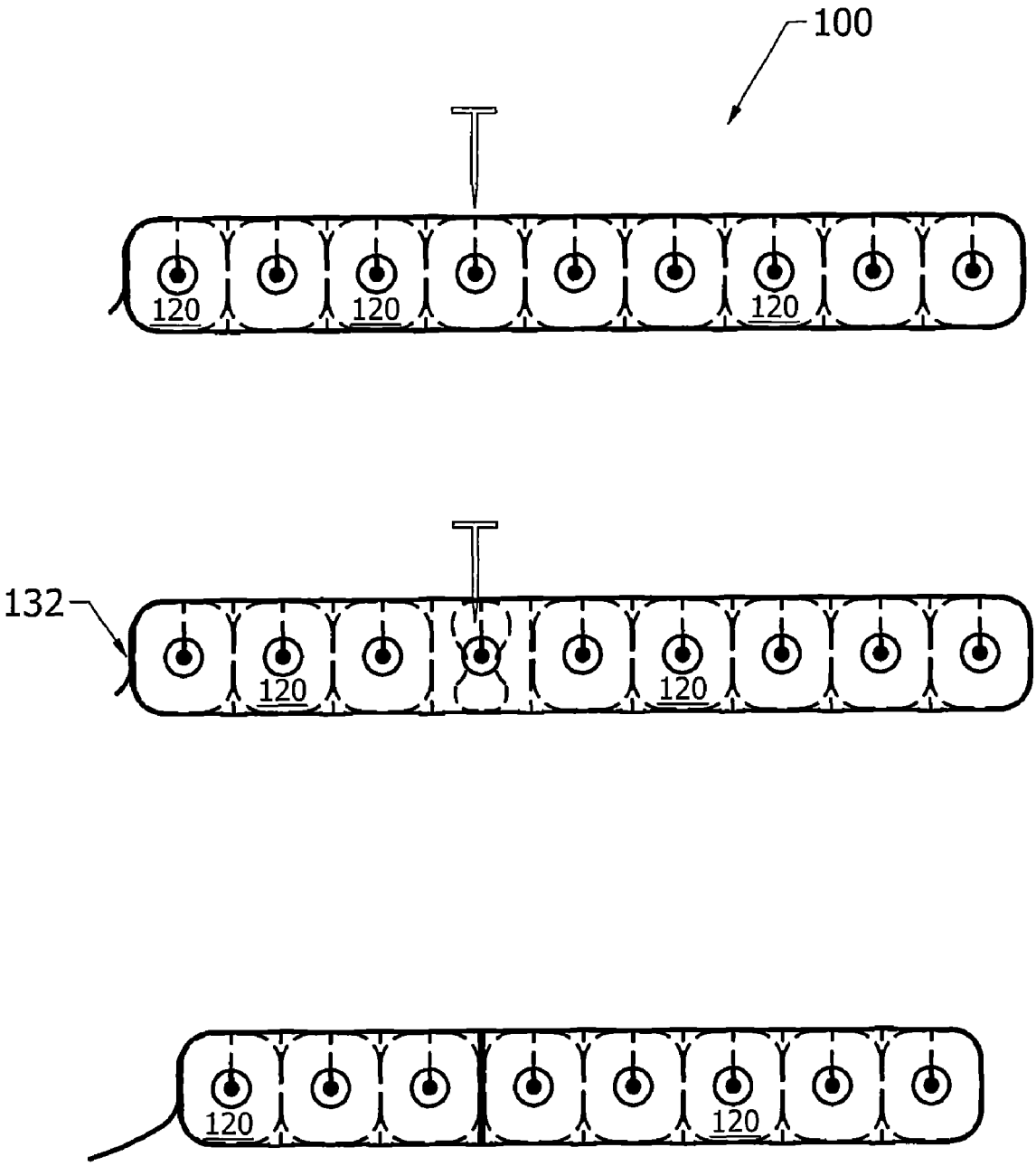
FIG. 6 illustrates a resizing of the inflatable device in accordance with the disclosed architecture.

The inflatable device 100 is generally rectangular in shape when inflated. The inflatable device 100 further comprises a head end 102, a foot end 104, a first side 106, and a second side 108. The head and foot ends 102 and 104 are approximately 70 to 74 inches long when all of the plurality of inflatable tubes 120 are in place and inflated. However, the length of the head and foot ends 102 and 104 are adjustable downward if any of the plurality of inflatable tubes 120 are deflated or removed. Therefore, the preferable length may range from the length of a single inflated tube, as discussed infra, to 74 inches as shown in FIG. 6. Returning to FIG. 1, the first and second sides 106 and 108 are approximately 76 to 80 inches long. When inflated, the inflatable device 100 is approximately between 8 and 10 inches high. However, these dimensions are not meant as a limitation, as embodiments that are smaller or larger as desired are contemplated to be within the scope of the invention. For example, the inflatable device 100 could be 96 inches long and 6 inches high.

Figure 2:
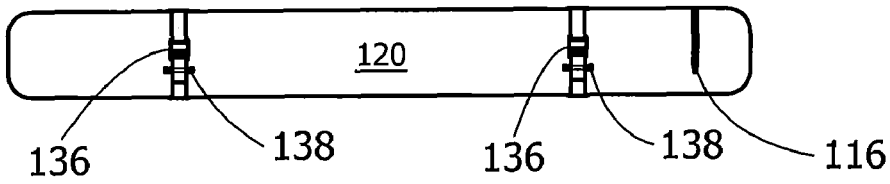
FIG. 2 illustrates an side view of the inflatable device in accordance with the disclosed architecture.

Furthermore, the outer cover 112 comprises a transverse opening 114 that generally extends across the entire width of a top side 110 of the inflatable device 100 and then extends down the first and second sides 106 and 108. However, the transverse opening 114 may extend further around the perimeter of the outer cover 112 if desired. While the transverse opening 114 is preferably located within 4 to 12 inches of the head end 102, the transverse opening 114 may be positioned anywhere along the outer cover 112 as long as it permits access to the plurality of inflatable tubes 120. For example, the transverse opening 114 in the preferred embodiment is located approximately 6 inches from the head end 102 and extends about 6 inches down both the first and second sides 106 and 108. As seen in FIG. 2, a closure mechanism 116 permits selective opening and closing of the transverse opening 114 as desired, such as to remove one of the plurality of inflatable tubes 118, for example. The closure mechanism 116 is preferably a zipper, however, hook and loop fasteners such as Velcro®, buttons, straps, ties, and the like, or any other closure device known to one of skill in the art may be used to close the transverse opening 114 without deviating from the scope of the invention.

Figure 5:
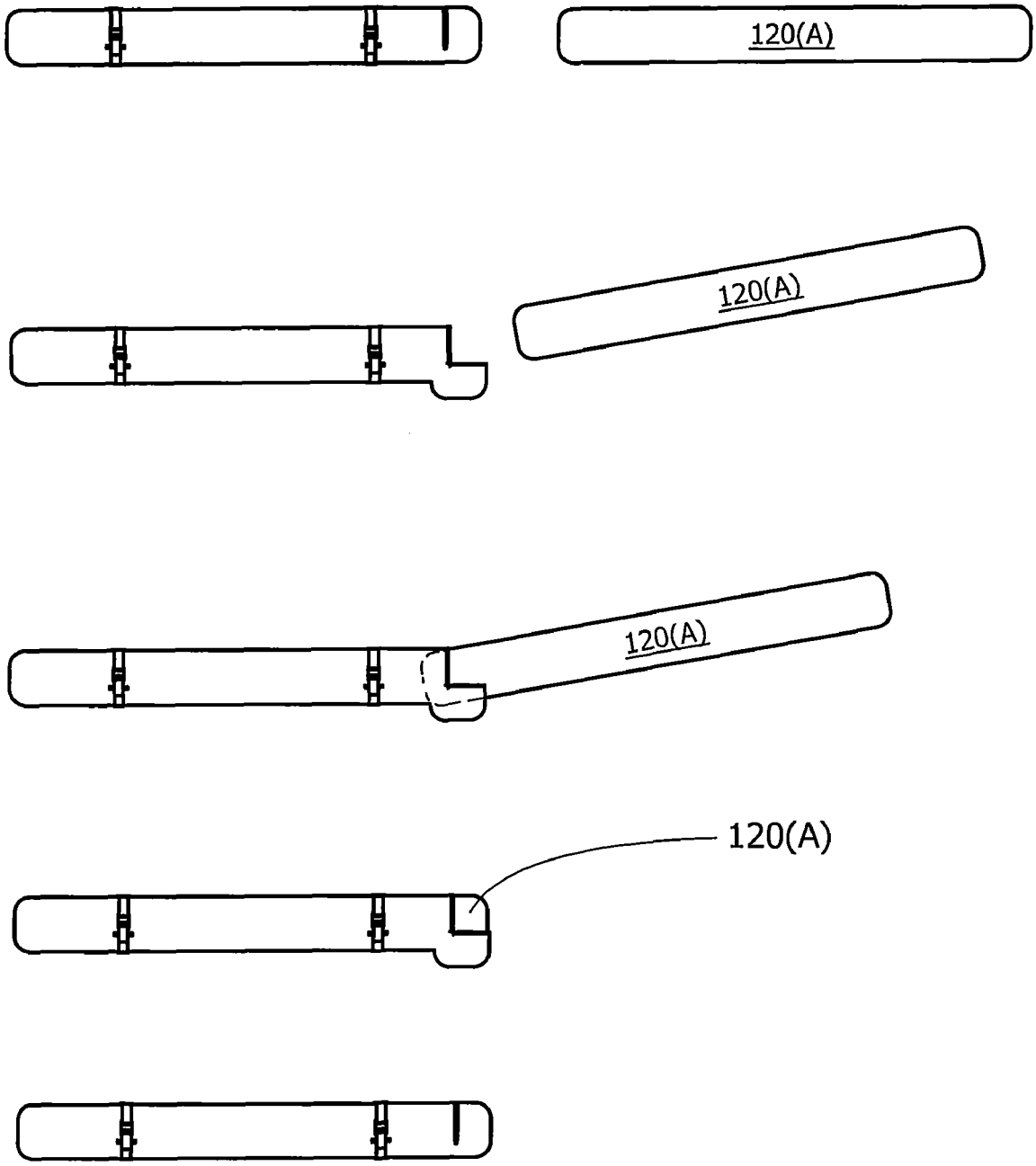
FIG. 5 illustrates an end view of one of the plurality of inflatable tubes being inserted into an outer cover of the inflatable device in accordance with the disclosed architecture.

The plurality of inflatable tubes 120 are each capable of maintaining a gas, such as air, under pressure. The plurality of inflatable tubes 120 are typically constructed of a thermoplastic material, however, they may made from any material capable of maintaining sufficient air under pressure to support a person known to one of skill in the art. While any number of the plurality of inflatable tubes 120 may be used, preferably there are nine. Additionally, as each of the plurality of tubes 120 is removable as seen in FIG. 5, the inflatable device 100 in the preferred embodiment may be used with between 1 and 9 tubes. Each of the plurality of inflatable tubes 120 are typically approximately the same dimension in length as the length of the inflatable device 100 as discussed supra when fully inflated. Additionally, each of the plurality of inflatable tubes 120 are typically approximately rectangular shaped about 9 inches high and 8 inches wide. However, the inventor contemplates embodiments where the plurality of inflatable tubes 120 are dimensioned to fit with in different sized outer covers as discussed supra.

Figure 3:
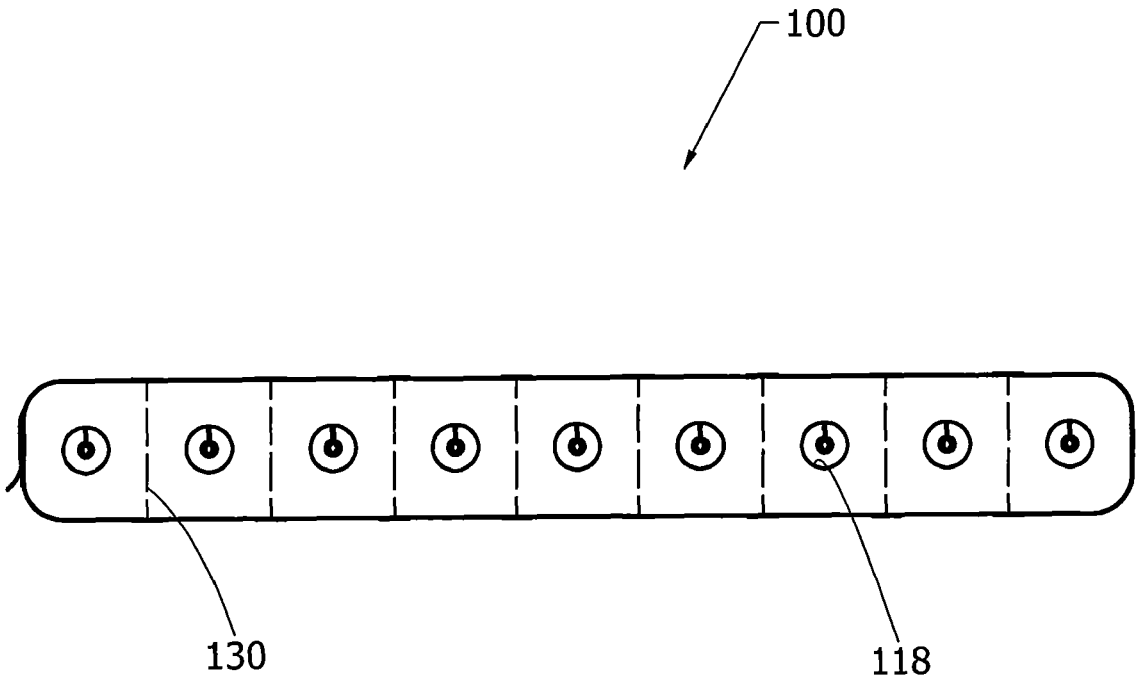
FIG. 3 illustrates a foot end view of the inflatable device in accordance with the disclosed architecture.

As shown in FIGS. 1 and 3, the plurality of inflatable tubes 120 are generally positioned side by side in a longitudinal coplanar arrangement. In other words, the plurality of inflatable tubes 120 are positioned substantially parallel to each other to form a single layer tube structure. Each of the plurality of inflatable tubes 120 further comprise a valve element 126 at one end for inflating and deflating said tube. Therefore, each of the plurality of tubes 120 is independently inflatable to a different pressure if desired.

Figure 4:
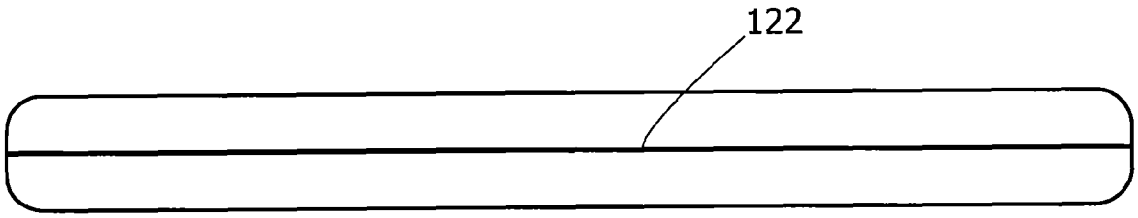
FIG. 4 illustrates a top view of one of a plurality of inflatable tubes in accordance with the disclosed architecture.
Figure 4A:
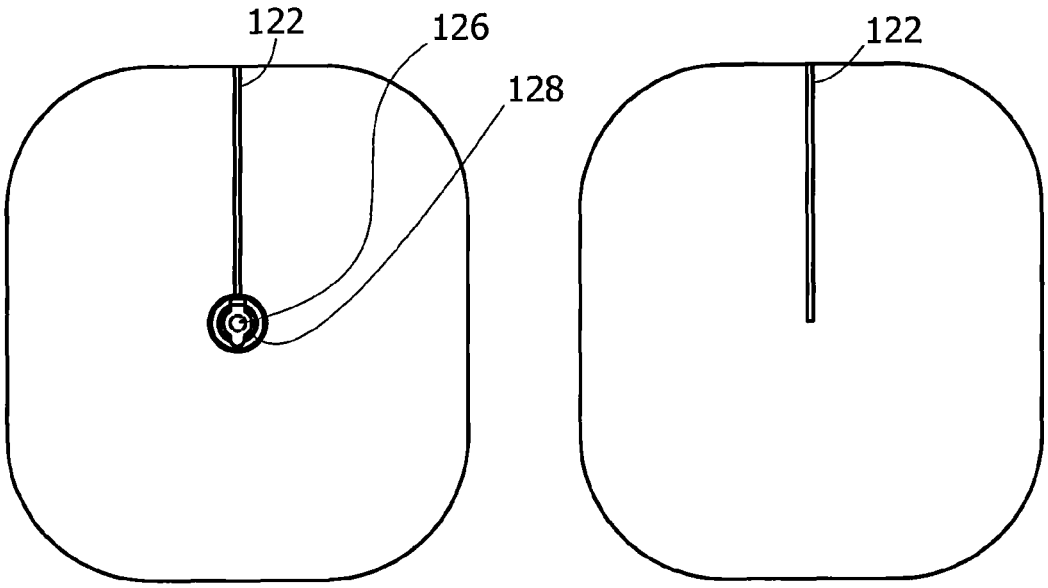
FIG. 4A illustrates a front and rear end view of one of the plurality of inflatable tubes in accordance with the disclosed architecture.

When the plurality of inflatable tubes 120 are positioned within the outer cover 112, the valve elements 126 are inserted toward the foot end 104 of the inflatable device 100. A plurality of valve access holes 118 for receiving the valve elements 126 penetrate the outer cover 112 in the foot end 104 of the inflatable device 100 so that the valve elements 126 protrude through the outer cover 112 when in place. Each of the plurality of inflatable tubes 120 is orientated so that they are taller than they are wide. A directional mark 122, as seen in FIGS. 4 and 4A, runs the length of a tube top side 124 extending around and terminating at the valve element 126. The directional mark 112 is used to align the plurality of inflatable tubes 120 so that they may easily be inserted into the cover element 112 in the proper geometric orientation.

Furthermore, the valve elements 126 typically comprise a self-sealing valve and a valve cover 128. However, any commercially available one-way type valve that allows air to flow in but not flow out without manipulation, such as by pinching the valve edges together may be used. The plurality of inflatable tubes 120 may be inflated by forcing air through the valve element 126 by mouth, pump, pressurized gas cylinder, and the like. Similarly, deflation may occur by manipulating or otherwise opening the valve element 126 so that air may escape. Optionally, an embodiment with a separate non-self-sealing valve on each or the plurality of inflatable tubes 120 may be employed to speed up deflation of the inflatable device 100.

The plurality of inflatable tubes 120 may be inflated to between 0.1 and 5 pounds per square inch (p.s.i.), but preferably between 0.25 and 0.5 p.s.i. as this will provide a comfortable range of firmness and support for a person. Additionally, the plurality of inflatable tubes 120 may be inflated to different pressures as each is independently inflatable. For example, if used as a two person mattress, some of the plurality of inflatable tubes 120 may be inflated to 0.3 p.s.i. and others to 0.5 p.s.i. to suit an individual's preference for firmness.

Returning to FIGS. 1 and 3, the inflatable device 100 further comprises a plurality of compartments 130 for positioning the plurality of inflatable tubes 120 within the outer cover 112. While any number of the plurality of compartments 130 may be used, preferably there are 9, so that each of the plurality of inflatable tubes 120 may be utilized. The plurality of compartments 110 run in a parallel configuration within the outer cover 112 so that they extend substantially from the head end 102 to the foot end 104. The dimensions are comparable to the plurality of inflatable tubes 120 as discussed supra so that the each tube fits snugly within the corresponding compartment as seen in FIG. 5. Preferably, the plurality of compartments 130 terminate at the transverse opening 114. In other words, approximately the first 6 inches from the head end 102 is an open area not defined by the plurality of compartments 130. Similarly, the plurality of compartments 130 need not extend the entire length of the inflatable device 100. For example, the last 6 inches at the foot end 104 may not be defined by the plurality of compartments 130 thereby reducing material costs. In addition, as each of the plurality of compartments 130 define a substantially empty space (not numbered), they are collapsible and may accordion-fold when the corresponding inflatable tube 120 is deflated or not otherwise in place.

While the plurality of inflatable tubes 120 are typically approximately rectangular in shape on their own, the plurality of compartments 130 also provide an additional shape-defining function as they substantially define the exterior shape of each of the plurality of inflatable tubes 120 within the outer cover 112. Therefore, in the event that the plurality of inflatable tubes 120 were cylindrical in shape, when inflated they would conform to the shape of the plurality of compartments 130 as illustrated in FIG. 3. In addition, a plurality of dead air spaces 142 will exist within the plurality of compartments 130 where the corners of each of the plurality of inflatable tubes 120 abut each other.

FIGS. 1 and 2 illustrate the at least one adjusting element 132 of which there are preferably two. The adjusting elements 132 are typically two inch wide nylon straps with a plastic buckle, however they may also comprise webbing, self tightening straps, rope, plastic, buttons, straps, hook and loop fasteners, and the like, or any other suitable material known to one of skill in the art. Additionally, the adjusting elements 132 may range from ⅛ to 3 inches in width, for example, 1½ inch straps may be employed. In the preferred embodiment, each of the adjusting elements 132 completely surrounds the outer cover 112, runs perpendicular to the direction of the plurality of inflatable tubes 120, and is located approximately 16 to 20 inches from both the head end 102 and the foot end 104. However, any number of adjusting elements 132 may be employed at a variety of locations around the outer cover 112 as required.

Figure 7:
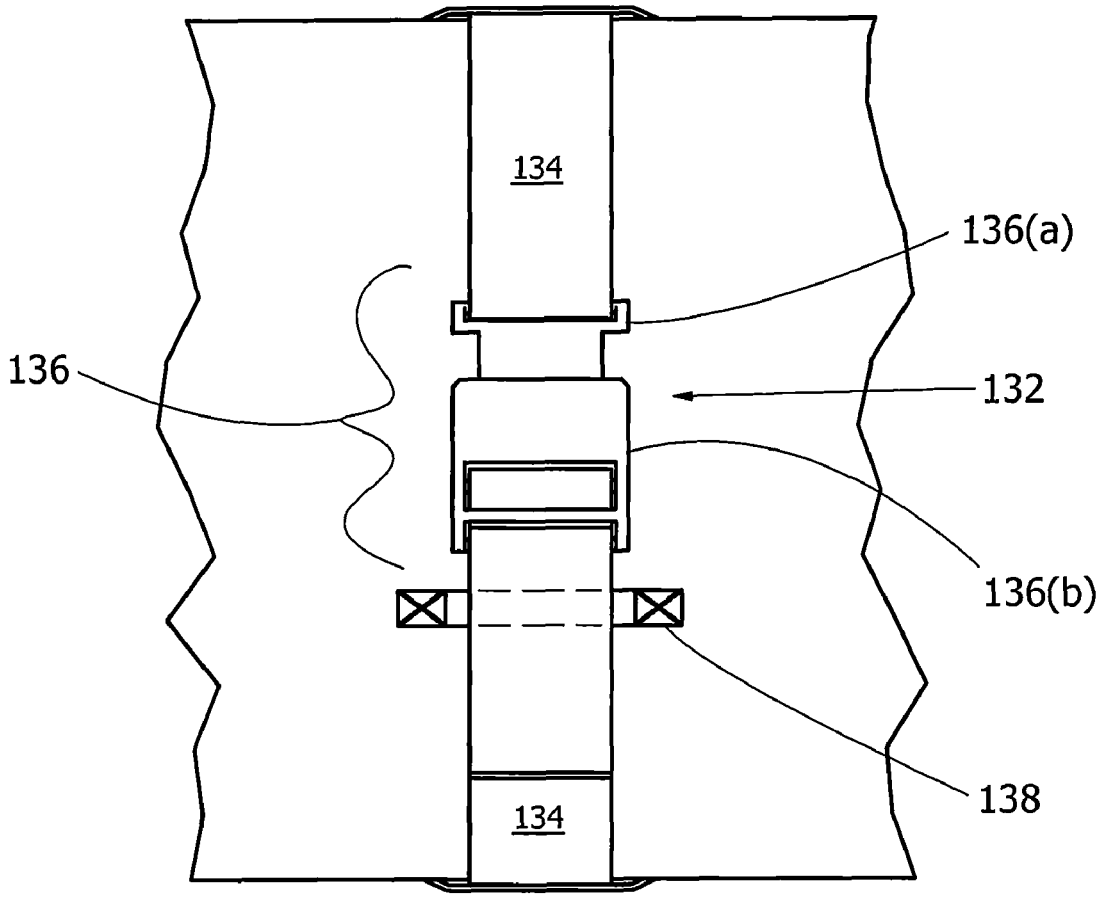
FIG. 7 illustrates a close-up view of a buckle used as an attachment element for adjusting the size of the inflatable device in accordance with the disclosed architecture.

Each of the at least one adjusting elements 132 may comprise a strap element 134 and a buckle element 136 as seen in FIG. 7. Further the buckle element 136 has a female end 136(*a*) and a male end 136(*b*). The strap element 134 is preferably permanently affixed to the outer cover 112 on the second side 108 with a holding strap 138 located approximately 1 to 2 inches from the female end 136(*b*) of the buckle element 136 as seen in FIG. 2. The holding strap 138 may be sewn, glued, riveted, radio-frequency welded, and the like, or attached by any method known to one of skill in the art. Additionally, the holding strap 138 may be located anywhere along the length of the strap element 134 or be eliminated without deviating from the scope of the invention.

Each of the adjusting elements 132 are held also in place and positioned by a plurality of loops 140. The plurality of loops 140 are attached to the outer cover 112 but not the strap element 134 in a similar method of attachment as the holding strap 138 as discussed supra. The strap element 134 simply weaves between the outer cover 112 and each of the plurality of loops 140 positioned to receive the strap element 132. There are preferably 40 of the loops 140 positioned at intervals for each of the strap elements 134. However, any number of the loops 140 may be used without deviating from the scope of the invention.

Prior to inflation for use, the inflatable device 100 is lightweight, and portable. The inflatable device 100 may be folded or rolled up for compact storage. To use, the inflatable device 100 is unpacked and laid flat. A pump (not shown) or other inflation method is employed to inflate as many of the plurality of inflatable tubes 120 as needed to attain a desired pressure and size of the device. Once inflated, the adjusting elements 132 are pulled taught so that the adjusting elements 132 are tight against the outer cover 112 along the entire circumference and the buckle element 136 is then engaged. In the event that one of the plurality of tubes 120 leaks or is otherwise removed, as seen in FIG. 6, the strap elements 134 are tightened so that the affected compartment 130 folds in on itself and the adjusting elements 132 keep the remaining tubes aligned in an uninterrupted layer. This allows the inflatable device 100 to continue to be used as an air mattress even if a leak develops in any one of plurality of independently inflatable tubes 120.

If the user desires to completely remove or replace one of the plurality of inflatable tubes 120, as seen in FIG. 5 the adjusting elements 132 are loosened, the closure mechanism 116 is unzipped, and the head end 102 opens along the transverse opening 114. The affected tube 120 may be removed and a new tube 120(*a*) is inserted in the same compartment 130 by aligning the directional mark 122 so that it will face the top side 110 of the inflatable device 100. The tube 120(*a*) is inserted with the valve element 126 entering the compartment 130 first. Once the tube 120(*a*) is in place, the closure mechanism 116 is zipped shut and the adjusting elements 132 are retightened.

What has been described above includes examples of the disclosed device. It is, of course, not possible to describe every conceivable combination of components and/or methodologies, but one of ordinary skill in the art may recognize that many further combinations and permutations are possible. Accordingly, the novel device is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An inflatable device for use as an air mattress, the inflatable device comprising:

a plurality of independently inflatable tubes each further comprising a valve element;

an outer cover configured to substantially encapsulate the plurality of inflatable tubes, wherein the outer cover comprises a plurality of shape-defining compartments for substantially defining an exterior shape of each of the plurality of inflatable tubes within the outer cover; and a plurality of adjusting elements that substantially surround the outer cover, wherein the plurality of adjusting elements may be tightened to change a width of the inflatable device; and a plurality of loops attached to the outer cover for positioning the plurality of adjusting elements.

2. The inflatable device of claim 1, wherein the plurality of independently inflatable tubes are individually inflatable to different pressures.

3. The inflatable device of claim 1, wherein the plurality of adjusting elements comprise two straps held in place by the plurality of loops, said two straps positioned perpendicularly to the plurality of independently inflatable tubes.

4. The inflatable device of claim 1, wherein a leak in any one of the plurality of independently inflatable tubes will not prevent use of the inflatable device as an air mattress.

* * * * *